US007553064B2

(12) United States Patent
Johnson et al.

(10) Patent No.: US 7,553,064 B2
(45) Date of Patent: Jun. 30, 2009

(54) AGITATING AND CONVEYING MACHINE FOR SHAKING A CONTAINER

(76) Inventors: Matthew J. Johnson, 2201 E. Horse Creek Ct., Meridian, ID (US) 83642; John R. Zweigle, 2020 S. Golden State Blvd., #101, Fowler, CA (US) 93625

( * ) Notice: Subject to any disclaimer, the term of this patent is extended or adjusted under 35 U.S.C. 154(b) by 0 days.

(21) Appl. No.: 12/007,587

(22) Filed: Jan. 11, 2008

(65) Prior Publication Data

US 2008/0192565 A1 Aug. 14, 2008

Related U.S. Application Data

(60) Provisional application No. 60/900,324, filed on Feb. 9, 2007.

(51) Int. Cl.
*B01F 11/00* (2006.01)

(52) U.S. Cl. ..... 366/109; 366/111; 366/218

(58) Field of Classification Search ..... 366/71–73, 366/108–116, 208–220, 233, 297; 198/598, 198/624; 492/27, 37
See application file for complete search history.

(56) References Cited

U.S. PATENT DOCUMENTS

| | | | | |
|---|---|---|---|---|
| 827,936 | A * | 8/1906 | Obermaier | 366/73 |
| 1,337,716 | A * | 4/1920 | Maddox | 366/208 |
| 1,414,197 | A * | 4/1922 | Maddox | 366/208 |
| 1,445,488 | A * | 2/1923 | Clark | 366/233 |
| 1,530,118 | A | 3/1925 | Hoepner | |
| 1,898,284 | A | 2/1933 | Belcher | |
| 1,947,029 | A | 2/1934 | Allison et al. | |
| 2,078,774 | A | 4/1937 | Ragot | |
| 2,304,982 | A | 12/1942 | Wilckens | |
| 2,458,387 | A | 1/1949 | Kindseth | |

(Continued)

FOREIGN PATENT DOCUMENTS

| | | |
|---|---|---|
| CA | 1108908 | 9/1981 |

(Continued)

OTHER PUBLICATIONS

Website, http://www.packexpo.com/ve/33350/main.html, series of processing machines by Batching Systems, Inc., eight pages printed from the internet on Jul. 5, 2006.

(Continued)

*Primary Examiner*—Charles E Cooley
(74) *Attorney, Agent, or Firm*—Richard C. Litman

(57) ABSTRACT

The agitation machine is installed either independently or in a conveyor line to shake, vibrate, oscillate, and/or agitate a container or containers in order to compact and settle the contents thereof. The machine includes at least one (and preferably two) elongate rotating bar or rod of non-circular cross section, or of eccentric circular cross section. The bars extend beneath the containers in the direction of their travel across or through the machine, with rotation of the bars resulting in the shaking or oscillating of the containers and resulting settling and compaction of the contents of the containers. The rotating oscillator bars may be adjusted so that their high edges are either in phase or out of phase with one another, respectively producing an alternating lifting and lowering action or a rocking action of the container resting thereon. The rotational speed of the bars may be adjusted as desired, as well.

16 Claims, 5 Drawing Sheets

U.S. PATENT DOCUMENTS

| | | | | | |
|---|---|---|---|---|---|
| 2,525,663 | A | * | 10/1950 | Frye | 241/178 |
| 2,653,015 | A | * | 9/1953 | Andrews | 366/213 |
| 2,798,699 | A | | 7/1957 | Peterson et al. | |
| 2,863,475 | A | | 12/1958 | Lau | |
| 3,091,435 | A | * | 5/1963 | Pease | 366/208 |
| 3,407,670 | A | | 10/1968 | Venanzetti | |
| 3,576,313 | A | | 4/1971 | Derderian | |
| 3,749,142 | A | | 7/1973 | Lau | |
| 4,283,188 | A | | 8/1981 | Wingerter et al. | |
| 4,515,579 | A | | 5/1985 | Beckett | |
| 4,516,210 | A | | 5/1985 | Dahlke | |
| 4,517,784 | A | | 5/1985 | Beckett | |
| 4,545,175 | A | | 10/1985 | Beckett | |
| 4,669,274 | A | * | 6/1987 | Huang | 62/342 |
| 4,744,195 | A | | 5/1988 | Reed | |
| 4,785,728 | A | * | 11/1988 | Miyata et al. | 99/535 |
| 4,821,203 | A | | 4/1989 | Carlton et al. | |
| 4,922,688 | A | | 5/1990 | Langen et al. | |
| 5,393,291 | A | | 2/1995 | Wingerter | |
| 5,473,866 | A | | 12/1995 | Maglecic et al. | |
| 5,669,711 | A | | 9/1997 | Spence, III et al. | |
| 6,089,283 | A | | 7/2000 | Sienerth et al. | |
| 6,158,200 | A | | 12/2000 | Taylor et al. | |
| 6,325,533 | B1 | * | 12/2001 | Kelley | 366/219 |
| 6,450,681 | B1 | * | 9/2002 | Nettelhoff et al. | 366/348 |
| 7,067,769 | B2 | | 6/2006 | Sands et al. | |
| 2004/0042339 | A1 | * | 3/2004 | Gebrian et al. | 366/208 |
| 2005/0115418 | A1 | | 6/2005 | Sands et al. | |
| 2006/0092756 | A1 | | 5/2006 | Lindbeck et al. | |
| 2006/0141113 | A1 | | 6/2006 | Kimmel et al. | |
| 2006/0237422 | A1 | | 10/2006 | Sands et al. | |
| 2008/0192565 | A1 | * | 8/2008 | Johnson et al. | 366/109 |

FOREIGN PATENT DOCUMENTS

| | | |
|---|---|---|
| CA | 1213340 | 10/1986 |
| CA | 1215909 | 12/1986 |
| GB | 2341600 | 3/2000 |
| JP | 63-287539 | 11/1988 |
| JP | 09-267802 | 10/1997 |
| WO | WO 90/00137 | 1/1990 |
| WO | WO 94/13537 | 6/1994 |
| WO | WO 2006/071484 | 7/2006 |

OTHER PUBLICATIONS

Website, http://www.packexpo.com/ve/37336/main.html, series of processing machines by Triangle Package Machinery Co., twelve pages printed from the internet on Jul. 5, 2006.

* cited by examiner

AGITATING AND CONVEYING MACHINE FOR SHAKING A CONTAINER

CROSS-REFERENCE TO RELATED APPLICATION

This application claims the benefit of U.S. Provisional Patent Application Ser. No. 60/900,324, filed Feb. 9, 2007.

BACKGROUND OF THE INVENTION

1. Field of the Invention

The present invention relates generally to conveyor and packaging machinery. More specifically, the present invention comprises a device utilizing a non-circular or non-concentric rotating bar or bars to agitate a container and its contents for settling and/or mixing the contents in the container or in packaging within the container.

2. Description of the Related Art

Containers for packaging and shipping various goods are generally sized to be as small as possible while still being capable of carrying or holding the required amount of product therein, in order to have the smallest practicable exterior dimensions for the container for maximizing shipping efficiency. In many instances, the product is not placed efficiently within the container during processing and packing, which results in the container either being underweight, or overflowing if sufficient product has been placed therein. This is particularly true of loose bagged articles, such as individual serving sizes of bagged goods such as potato chips, individual size and larger bags of individual candies, etc., as well as some fresh and frozen fruit and vegetable products and frozen poultry, meat, and fish products which may be packed loosely within a container.

In other instances, two or more varieties of a product may be placed in individual packages or in larger containers, e.g., different types or flavors of candies, snack foods, etc. The different varieties may not be well mixed as they are dumped into the packaging or container by means of conveyors and/or delivery chutes during the packaging operation.

This has led to the development of agitation or vibration devices for shaking, vibrating, and/or agitating the container in order to settle the contents therein. Numerous such devices have been developed in the past, utilizing various principles of operation. One common principle used in such vibrator devices is the eccentric mass, wherein a rotary shaft having an eccentric mass thereon produces a vibration or shaking as it rotates. The problems with this type of device are (1) the eccentric loads placed upon the rest of the structure, which may lead to damage to the structure or alternatively require a considerably heavier and more costly machine; and (2) the inability of such a device to produce a very slow oscillation of the product, due to the very low momentum of the offset mass at very low operating speeds.

Another principle used in vibration producing machines is that of the reciprocating mechanism, in which an arm or rod is reciprocated by an eccentric wheel or linearly reciprocating actuator (hydraulic strut, etc.). The mass may or may not be counterbalanced, as the linear motion of the end of the reciprocating arm is the primary producer of the vibratory or shaking action. While this principle of operation may be used to produce relatively slow movement of the subject container or article, it requires a relatively complex cyclical mechanism to carry out the operation.

The present inventors are aware of various vibratory and/or oscillating devices developed in the past. An example of such may be found in Japanese Patent No. 63-287,539, published on Nov. 24, 1988. According to the drawings and English abstract, this mechanism produces a rocking action to agitate a fluid contained within a cylinder captured between opposed anchors. No further detail is apparent regarding the principle of operation.

Another example of a vibration- or oscillation-producing machine is found in Japanese Patent No. 09-267,802 published on Oct. 14, 1997. This device comprises a machine installed beneath the edge of a truck loading dock or the like, which clamps to the lifting or anchoring pockets of a semi-trailer supported shipping container. The device utilizes eccentric weights spun by large electric motors to shake and vibrate the container and its load. The problems with the eccentric mass principle of vibration production have been noted further above.

Thus, an agitation machine solving the aforementioned problems is desired.

SUMMARY OF THE INVENTION

The agitation machine is installed either independently or in a conveyor line to shake, vibrate, oscillate, and/or agitate a container or containers in order to compact and settle the contents of the container. The machine includes at least one (and preferably two) elongate rotating bar or rod of non-circular cross section, or of eccentric circular cross section. The bars extend beneath the containers in the direction of travel of the containers across or through the machine, with rotation of the bars resulting in the shaking or oscillating of the containers and resulting settling and compaction of the contents of the containers. The rotating oscillator bars may be adjusted so that their high edges are either in phase or out of phase with one another, respectively producing an alternating lifting and lowering action or a rocking action of the container resting thereon. The rotary speed of the bars may be adjusted as desired.

Several embodiments of the agitation machine are disclosed herein. One embodiment includes two spaced apart conveyors carrying a series of lateral flight bars therebetween. The flight bars convey the containers along the rotating agitator or oscillator bars during operation of the machine. A central runner of variably adjustable height is preferably placed between the two agitator bars, with the runner limiting the low point of the container oscillation, and therefore the amplitude of the oscillation, as the agitator bars lift and lower the container.

Another embodiment dispenses with the flight bar conveyor system, but includes a relatively narrow central conveyor belt between the two non-circular section oscillator bars. The container(s) rest(s) upon the central conveyor to a greater or lesser degree, depending upon the height of the vertically adjustable conveyor. Other embodiments comprise various rotary oscillator bars having different non-circular, or eccentric circular, cross sections.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
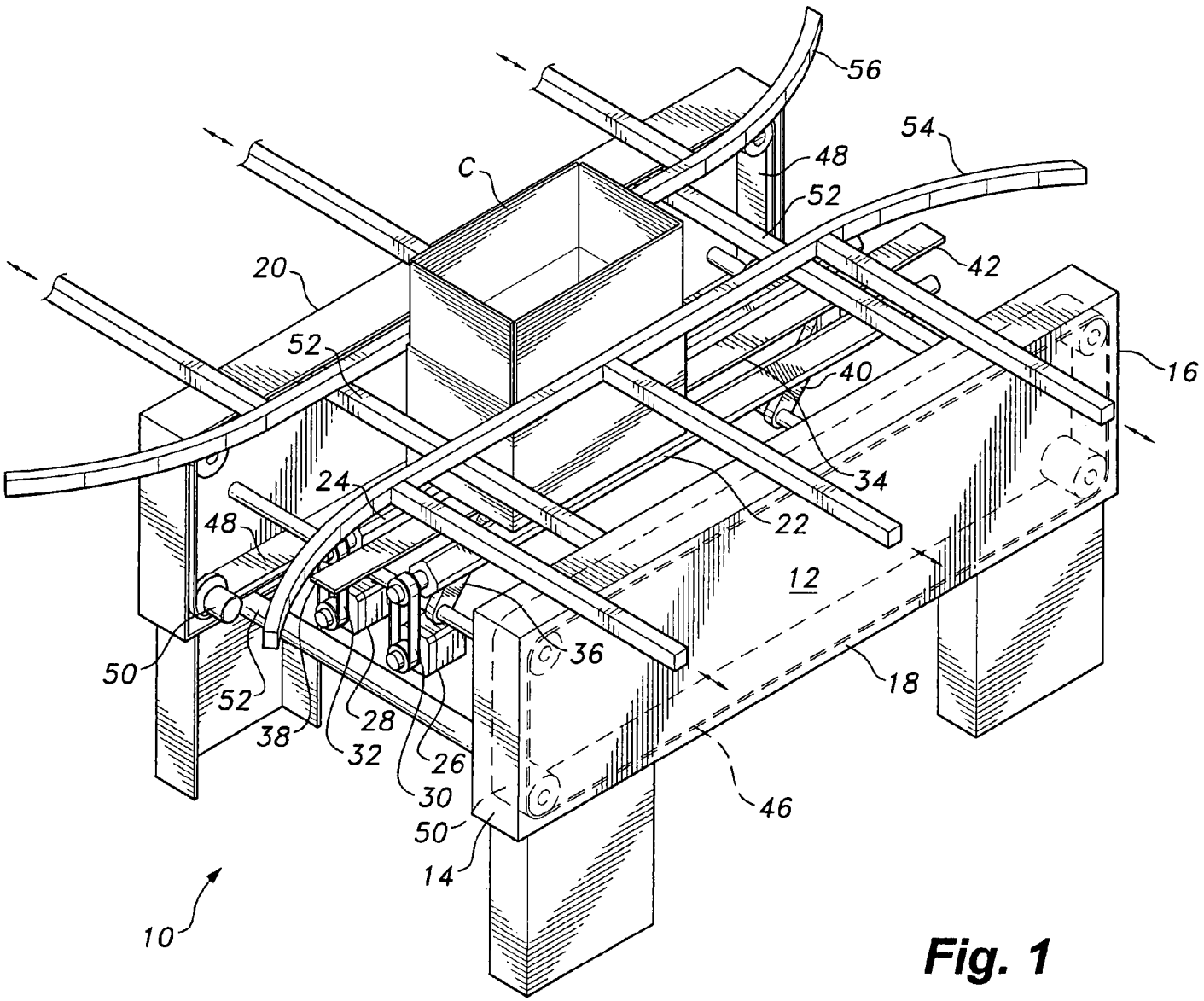
FIG. 1 is an environmental, perspective view of an agitation machine according to the present invention, illustrating its general features and operation.
Figure 2:
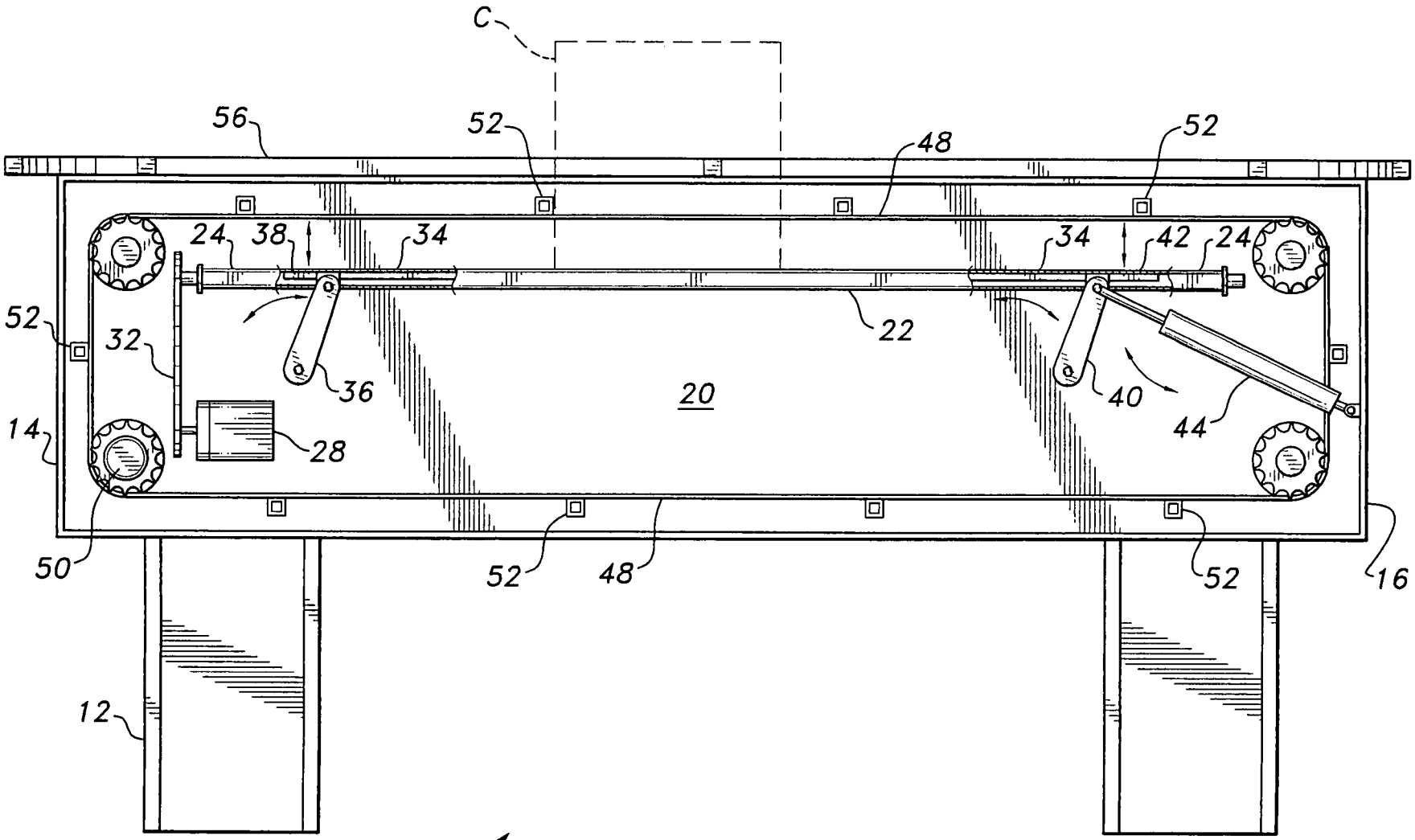
FIG. 2 is a side elevation view in section of the machine of FIG. 1, showing further details thereof.
Figure 3:
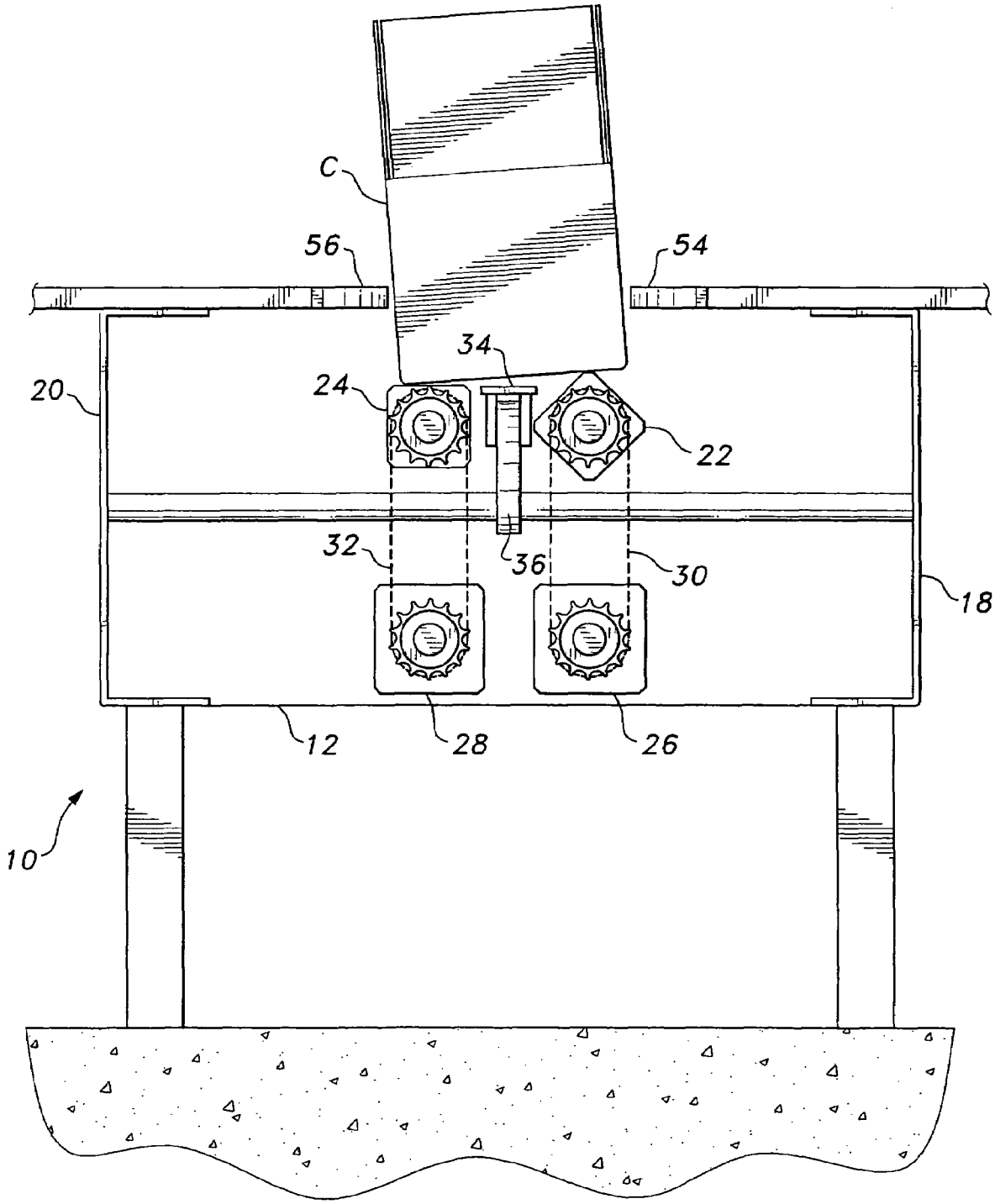
FIG. 3 is a simplified end view in section of the embodiment of FIG. 2, with the lateral conveyor system deleted to show further features in detail.

The present invention comprises various embodiments of an agitation machine which shakes, oscillates, vibrates, and/or agitates a container C placed thereon, to settle the contents of the container. FIGS. 1 through 3 of the drawings provide illustrations of a first embodiment 10 of the present machine, with FIG. 3 being somewhat simplified by the omission of a conveyor component for clarity in the drawing.

Figure 5:
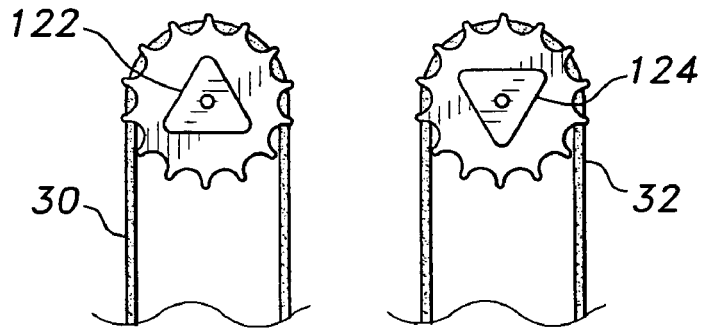
FIG. 5 is an end elevation view in section of an alternative embodiment configuration of triangular section agitator bars of the machine.
Figure 6:
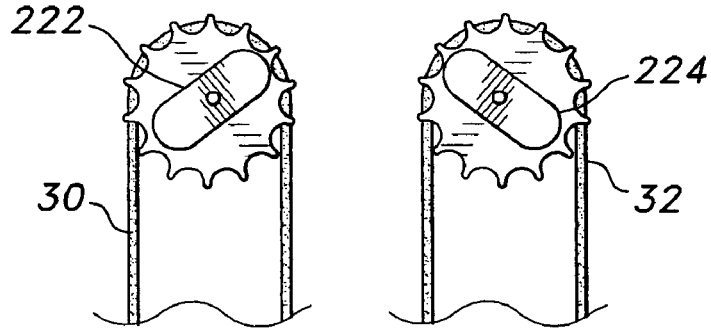
FIG. 6 is an end elevation view in section of an alternative embodiment configuration of oval section agitator bars of the machine.
Figure 7:
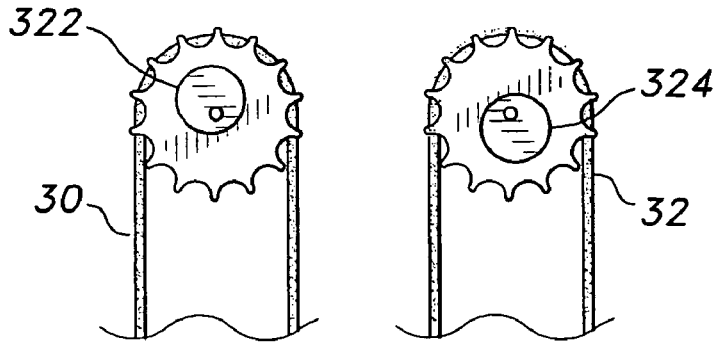
FIG. 7 is an end elevation view in section of an alternative embodiment configuration of non-concentric circular section agitator bars of the machine.

The agitation machine 10 includes a frame 12 having opposite first and second ends, respectively 14 and 16, and opposite first and second sides, respectively 18 and 20. At least one rotary oscillator bar extends generally from the first end 14 to the second end 16 of the frame 12, with the container C being supported directly upon the oscillator bar or bars. Preferably, parallel first and second oscillator bars, respectively 22 and 24, are installed in the machine 10 and extend generally from end to end of the frame 12 to each side of the centerline of the machine. The oscillator bars 22 and 24 are supported by conventional bearings (not shown) at each of their ends. The oscillator bars 22 and 24 are non-circular in cross section, as may be seen in the end view of FIG. 3. While the oscillator bars 22 and 24 each have square cross sections, it will be understood that any practicable non-circular cross section may be used. Various examples of such are illustrated in FIGS. 5 through 7, and discussed further below.

Each of the oscillator bars 22 and 24 is rotated by a corresponding oscillator bar drive motor, respectively 26 and 28. The drive motors are preferably conventional stepper or servo drive motors operated synchronously in order to synchronize the rotation of the two oscillator bars relative to one another. Flexible, synchronous drive members, respectively 30 and 32, extend between the motors 26 and 28 and their respective oscillator bars 22 and 24. The drive members 30 and 32 may comprise toothed belts driven from and driving correspondingly toothed drive wheels or sprockets, as shown in FIG. 1, or roller chains driven from and driving corresponding sprockets, etc., a shown in other drawings. Alternatively, conventional gear trains may be used to transmit the driving torque from the motors to the oscillator bars, or a single motor may be used to drive both bars through suitable transmission means.

The use of stepper or servomotors operated synchronously for oscillator bar drive motors 26 and 28 results in the two oscillator bars 22, 24 rotating synchronously with one another. For example, the high point or edge of one of the bars, e.g., the first bar 22, may be oriented upwardly at the same time the flat or low point of the second bar 24 is oriented upwardly, as shown in FIG. 3 of the drawings. This results in a rocking, shaking, or vibrating action upon the container C resting directly atop the two bars 22 and 24 as the two bars continue to rotate with their respective low or flat surfaces alternately oriented upwardly at the same instant that the high point of the opposite bar is oriented upwardly. However, the use of motors operated synchronously as the oscillator bar drive means also allows the motors to be adjusted relative to one another so the higher edges and lower flats of the two bars are alternately oriented upwardly simultaneously with one another, thereby resulting in a series or periodic upward jolts and downward drops for the container C resting atop the bars. Moreover, the rotational speed of the two bars may be adjusted as desired to result in relatively rapid jarring of the container C and its contents, or a slower rocking or lifting and lowering of the container C. Preferably, the two oscillator bars 22 and 24 rotate in opposite directions relative to one another in order to cancel the lateral frictional forces transmitted to the container C supported thereon, but they may be made to rotate in the same direction if so desired.

While the frequency of the oscillatory pulses is controlled by the rotational speed of the two oscillator bars 22 and 24, the amplitude of the pulses is set by the difference between the height of the highest point or edge and the lowest point or flat of the bars. In the example shown in FIGS. 1 through 3, the bars 22 and 24 each have square cross sections. Thus, the amplitude of the oscillatory pulses is equal to one half of the difference between the span of the diagonal and the span between two opposed flats of the bars. For example, if the bars have a width across their flats of two inches, the diagonal measurement across the opposite corners is approximately 2.828 inches. One half the difference results in an amplitude of about 0.414 inches between the flat and diagonal edge of such a two-inch width bar as it rotates. The example using a bar(s) of square cross section was selected as square section tubing and bar stock is relatively inexpensive in comparison to other non-circular cross-sectional shapes. However, other cross-sectional shapes may be selected for the two oscillator bars, as desired and discussed further below. Moreover, it is not necessary that the two bars have the same cross-sectional shape.

It will be noted that the above-described means of selecting or setting the vibratory amplitude of the machine does not provide for adjustment of that amplitude. Accordingly, such amplitude adjustment means may be provided with the machine 10, as shown in FIGS. 1 through 3. The agitation machine 10 includes an elongate, vertically adjustable container support runner 34 within the frame 12 and extending generally between the two ends 14 and 16 thereof. More specifically, the runner 34 is located along the centerline of the machine 10, substantially centered between the two oscillator bars 22 and 24 and parallel thereto. The height of the container support runner 34 may be adjusted as desired to allow the container C to come to rest upon the runner 34, rather than dropping completely to the low point defined by the oscillator bars 22 and 24 during their rotation. Thus, raising the height of the container support runner 34 results in a lower amplitude oscillation for the container C as it passes through the machine.

FIG. 2 of the drawings provides a detailed view of the mechanism used to adjust the height of the container support runner 34. The first oscillator bar 22 is shown broken away at each of its ends in order to show the support runner 34, which is aligned generally in the same plane with the two oscillator bars 22 and 24 in FIG. 2. The support runner 34 is supported by a first runner support arm 36 which extends pivotally from the frame 12 and pivotally attaches near the first end 38 of the runner 34, and by a second runner support arm 40 extending pivotally from the frame 12 and attaching pivotally near the opposite second end 42 of the support runner 34. The two support arms 36 and 40 are parallel to one another, with the frame 12, support arms 36 and 40, and support runner 34 defining a parallelogram with variable angles and height. A support runner height adjustment actuator 44, e.g., hydraulic cylinder, electric or hydraulic screw jack, etc., extends from one end of the frame 12 to the container support runner 34, or to the support runner attachment end of one of the two support arms 36 and 40, to adjust the configuration of the support runner parallelogram and thus the height of the support runner 34.

In the geometric configuration illustrated in FIG. 2, extending the actuator 44 causes the two support arms 36 and 40 to pivot to a more vertical orientation, thus raising the height of the container support runner 34 relative to the two oscillator bars 22 and 24. Adjustment of the height of the container support runner 34 as desired above the low point defined by the oscillator bars 22 and 24 during their rotations, results in reducing the amplitude of the vibration or oscillation produced by the bars 22 and 24 due to the container C contacting the higher container support runner 34 before it can fall to the low point of the bars during their rotations. Thus, the container support runner 34 may be adjusted to produce as little or as much amplitude as desired up to the maximum range defined by the two oscillator bars 22 and 24.

To this point, no means has been described for conveying the container C from one end of the machine 10 to the other during its operation. The two rotary oscillator bars 22 and 24 produce a purely lateral motion upon the bottom of the container C as they rotate, while the container support runner 34 remains stationary once its height has been set. Accordingly, the machine 10 includes means for advancing the container(s) C from one end to the other. This is accomplished by opposite first and second flight bar conveyors, respectively 46 and 48, respectively located within the first and second sides 18 and 20 of the frame 12. The flight bar conveyors 46 and 48 are driven by synchronized drive motors 50.

The flight bar conveyors 46 and 48 include at least one (and preferably a series of) flight bar(s) 52 extending therebetween. Thus, as the flight bar conveyors 46 and 48 travel about the inner sides of n the frame 12, they carry the laterally disposed flight bars 52 with them. The flight bars 52 engage the trailing end or surface of the container C, to push the container over and along the oscillator bars 22 and 24 and the central container support runner 34. Mutually opposed and laterally adjustable first and second guide bars, respectively 54 and 56, are preferably provided to prevent excessive lateral movement of the container C as it rocks upon the oscillator bars 22 and 24 during operation of the machine.

Figure 4:
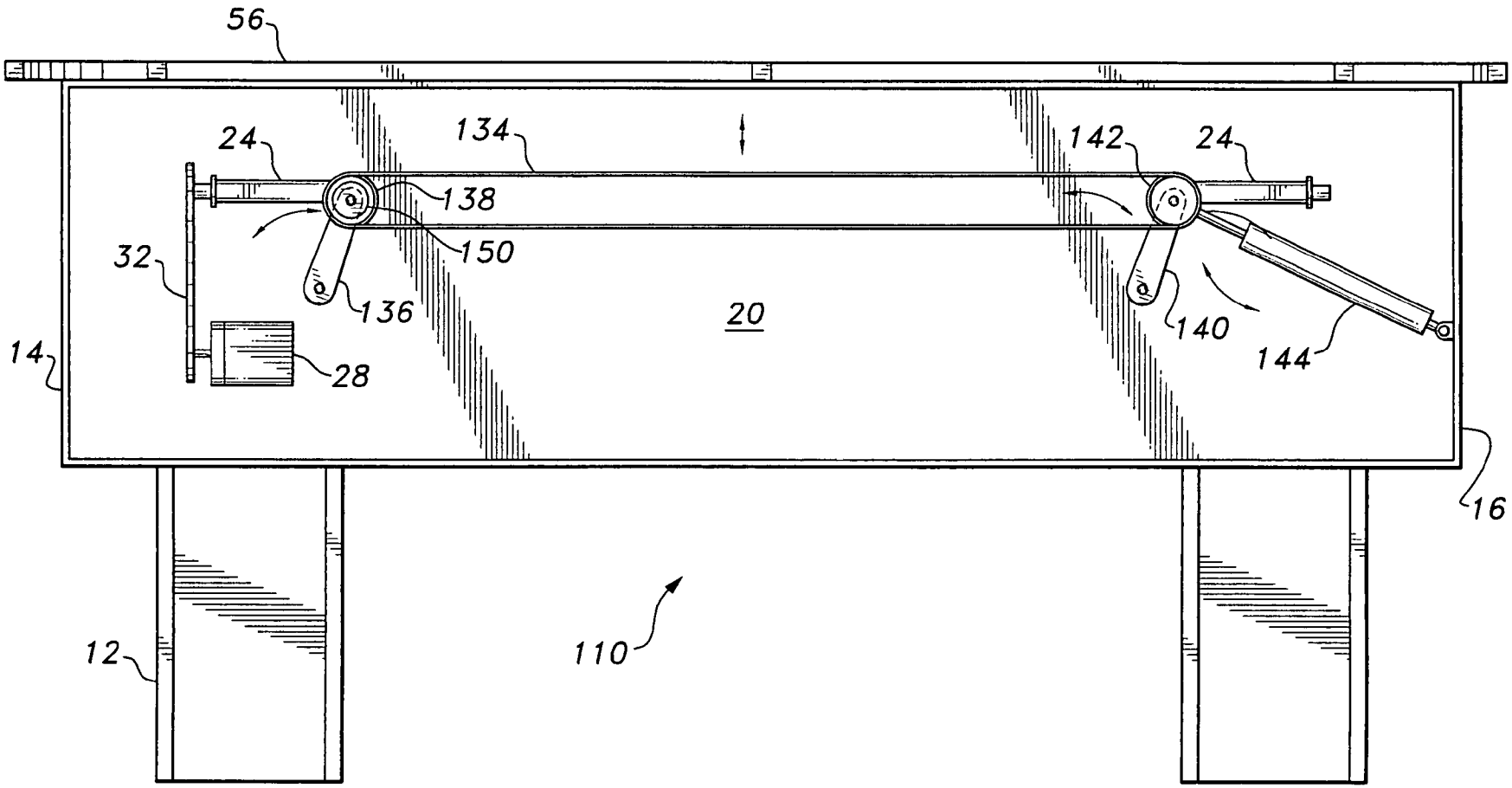
FIG. 4 is a side elevation view in section of an alternative embodiment of the machine, in which the lateral conveyor and flight bar system is removed and a narrow central conveyor substituted therefor.

FIG. 4 of the drawings provides a side elevation view in section of an alternative embodiment agitation machine 110. Most of the components of the agitation machine 110 are identical to those of the machine 10 shown in FIGS. 1 through 3 and utilize identically corresponding reference numerals, e.g., frame 12, second oscillator bar 24, oscillator bar drive motor 28, etc. However, it will be noted that the agitation machine 110 of FIG. 4 does not include a flight bar conveyor system therewith. In order to move the container(s) C along the length of the agitation machine 110, the machine includes an elongate, centrally disposed container support conveyor 134 within the frame, parallel to the oscillator bar(s) and preferably positioned between a first and second oscillator bar; the opposite ends of the second bar 24 are visible in FIG. 4, with the majority of the second bar 24 being concealed behind the container support conveyor 134.

The container support conveyor 134 is supported by opposite first end and second end rollers, sprockets, etc., respectively 138 and 142, which are in turn supported upon pivotally mounted first and second conveyor support arms 136 and 140. As the container support conveyor 134 is a flexible belt rather than a rigid member as in the case of the container support runner 34 of the first embodiment 10 of FIGS. 1 through 3, a rigid brace (not shown) is installed between the two conveyor end rollers 138 and 142.

The two conveyor support arms 136 and 140 are pivotally mounted to the frame 12, with the frame 12, conveyor support arms 136 and 140, and the conveyor 134 forming the sides of an adjustable parallelogram. The angles of the parallelogram, and thus the height of the conveyor 134, are adjusted by a conveyor height adjustment actuator 144, corresponding to the runner height adjustment actuator 44 of the embodiment of FIGS. 1 through 3. Thus, the conveyor 134 may be raised or lowered to provide greater or less support to a container resting thereon and being agitated by the oscillator bars 22 and 24 to each side of the conveyor. The higher the conveyor 134 is raised, the greater percentage of time a container thereon is in contact with and carried along by the conveyor. Conversely, lowering the conveyor 134 results in the container being in contact with the conveyor for a smaller percentage of time, resulting in a longer time period of travel through the machine 110. Alternatively, the speed of the conveyor may be adjusted by means of the conveyor drive motor 150 at the first end roller 138, if so desired.

FIGS. 5 through 7 provide end elevation views of a series of alternative cross-sectional shapes for the oscillator bars of the present agitation machine. It will be understood that any of the agitator bar cross-sectional shapes shown in FIGS. 5 through 7, and innumerable others, may be installed in either of the machines 10 or 110 described herein. Also, the various shapes, and others, may be combined if so desired, e.g., one bar having a square cross section with a second bar having a cross section of other than square polygonal shape, etc. Moreover, the cross-sectional shape of any given bar(s) may be altered along the length of the bar(s), if so desired. While the use of square cross section bar stock or tubing is desired for the manufacture of the oscillator bars due to its relative economy in comparison to other cross-sectional shapes, it will be seen that the non-circular section oscillator bars are by no means limited to any particular cross-sectional shapes.

FIG. 5 provides an end view illustration of first and second oscillator bars 122 and 124, each having a triangular cross section. The triangular cross-sectional shapes of the two bars 122 and 124 need not be equilateral triangles, but may comprise any regular or irregular triangular shape as desired.

FIG. 6 illustrates an end view of first and second oscillator bars 222 and 224 having oval cross-sectional shapes. The oval shapes may be adjusted to provide any particular aspect ratio as desired, and/or either or both bars may be formed to have an elliptical or other non-circular cross section, as desired.

FIG. 7 is an end view illustration of first and second oscillator bars 322 and 324 each having an axially offset configuration. While the outside circumference of the two bars 322 and 324 is circular, it will be noted that they do not define a circular path when rotated due to their axial offset from their rotational axes. Thus, their peripheries produce a non-circular path when the bars 322 and 324 are rotated about their offset axes. Such axially offset bars may be balanced to avoid mass imbalance, if so desired, as may any of the other non-circular shapes that may be used for the oscillator bars of the present machine.

In conclusion, the agitation machine in its various embodiments and configurations provides a superior means of shaking, agitating, oscillating, vibrating, or otherwise jostling and stirring a container passing therethrough and the contents within the container. The agitation machine provides agitation without need for mass imbalance and its accompanying vibrational loads that are transmitted to the entire machine. Moreover, the oscillatory speed of the machine may be adjusted within any practicable range as desired. This allows the machine to produce very low frequency rolling actions upon a container to gently mix materials therein, if so desired, or very rapid agitation or vibration of the container if required, or any other vibrational or oscillatory frequency therebetween. Moreover, the use of two oscillator bars allows the bars to be set either in phase with one another to produce purely vertical motion, or out of phase with one another to produce a rocking motion of the container resting thereon. Also, the machine is well adapted for installation in a conveyor line including a container indexing unit at the infeed end of the machine, a container closing and gluing station at the outfeed end, and/or other processing machines in a conveyor line. Accordingly, the agitation machine will prove to be most valuable in the processing of countless goods and products along a conveyor line.

It is to be understood that the present invention is not limited to the embodiments described above, but encompasses any and all embodiments within the scope of the following claims.

We claim:

1. An agitation machine for shaking a container and its contents, the agitation machine comprising:

a frame having a first end, a second end opposite the first end, a first side, and a second side opposite the first side;

at least one rotary oscillator bar of non-circular cross section, disposed within the frame, the oscillator bar extending generally from the first end to the second end of the frame, the bar being adapted for supporting the container directly thereon;

at least one oscillator bar drive motor communicating with the at least one oscillator bar;

a first flight bar conveyor disposed within the first side of the frame;

a second flight bar conveyor disposed within the second side of the frame;

at least one flight bar extending between the first flight bar conveyor and the second flight bar conveyor; and at least one flight bar conveyor drive motor communicating with the first and the second flight bar conveyor.

2. The agitation machine according to claim 1, further including an elongate, vertically adjustable container support runner disposed within the frame substantially parallel to the at least one oscillator bar, the container support runner having a first end and a second end opposite the first end.

3. The agitation machine according to claim 2, further including:

a first runner support arm pivotally extending between the frame and the first end of the container support runner;

a second runner support arm pivotally extending between the frame and the second end of the container support runner parallel to the first runner support arm; and a runner height adjustment actuator extending between the frame and the container support runner.

4. The agitation machine according to claim 1, further including:

an elongate, vertically adjustable container support conveyor disposed within the frame substantially parallel to the at least one oscillator bar, the container support conveyor having a first end and a second end opposite the first end; and a conveyor drive motor communicating with the container support conveyor.

5. The agitation machine according to claim 4, further including:

a first conveyor support arm pivotally extending between the frame and the first end of the container support conveyor;

a second conveyor support arm pivotally extending between the frame and the second end of the container support conveyor parallel to the first conveyor support arm; and a conveyor height adjustment actuator extending between the frame and the container support conveyor.

6. The agitation machine according to claim 1, wherein the at least one oscillator bar comprises a first oscillator bar and a second oscillator bar substantially parallel to the first oscillator bar.

7. The agitation machine according to claim 1, wherein:

the oscillator bar drive motor is selected from the group consisting of stepper drive motors and servomotors; and a flexible synchronous drive member extends between the oscillator bar and the oscillator bar drive motor.

8. An agitation machine for shaking a container and its contents, the agitation machine comprising:

a frame having a first end, a second end opposite the first end, a first side, and a second side opposite the first side;

at least one rotary oscillator bar of non-circular cross section disposed within the frame, the oscillator bar extending generally from the first end to the second end of the frame, the oscillator bar being adapted for supporting the container directly thereon;

at least one oscillator bar drive motor communicating with the at least one oscillator bar;

an elongate, vertically adjustable container support runner disposed within the frame substantially parallel to the at least one oscillator bar, the container support runner having a first end and a second end opposite the first end;

a first runner support arm pivotally extending between the frame and the first end of the container support runner;

a second runner support arm pivotally extending between the frame and the second end of the container support runner parallel to the first runner support arm; and a runner height adjustment actuator extending between the frame and the container support runner.

9. The agitation machine according to claim 8, further including:

a first flight bar conveyor disposed within the first side of the frame;

a second flight bar conveyor disposed within the second side of the frame;

at least one flight bar extending between the first flight bar conveyor and the second flight bar conveyor; and at least one flight bar conveyor drive motor communicating with the first and the second fight bar conveyor.

10. The agitation machine according to claim 8, wherein the at least one oscillator bar comprises a first oscillator bar and a second oscillator bar substantially parallel to the first oscillator bar.

11. The agitation machine according to claim 8, wherein:

the oscillator bar drive motor is selected from the group consisting of stepper drive motors and servomotors; and a flexible synchronous drive member extends between the oscillator bar and the oscillator bar drive motor.

12. An agitation machine for shaking a container and its contents, the agitation machine comprising:

a frame having a first end, a second end opposite the first end, a first side, and a second side opposite the first side;

at least one rotary oscillator bar of non-circular cross section disposed within the frame the oscillator bar extending generally from the first end to the second end of the frame, the oscillator bar being adapted for supporting the container directly thereon;

at least one oscillator bar drive motor communicating with the at least one oscillator bar;

an elongate, vertically adjustable container support conveyor disposed within the frame substantially parallel to the at least one oscillator bar, the container support conveyor having a first end and a second end opposite the first end; and a conveyor drive motor communicating with the container support conveyor.

13. The agitation machine according to claim 12, further including:

a first conveyor support arm pivotally extending between the frame and the first end of the container support conveyor;

a second conveyor support arm pivotally extending between the frame and the second end of the container support conveyor parallel to the first conveyor support arm; and a conveyor height adjustment actuator extending between the frame and the container support conveyor.

14. The agitation machine according to claim 12 further including:

a first flight bar conveyor disposed within the first side of the frame;

a second flight bar conveyor disposed within the second side of the frame;

at least one flight bar extending between the first flight bar conveyor and the second flight bar conveyor; and at least one flight bar conveyor drive motor communicating with the first and the second fight bar conveyor.

15. The agitation machine according to claim 12, wherein the at least one oscillator bar comprises a first oscillator bar and a second oscillator bar substantially parallel to the first oscillator bar.

16. The agitation machine according to claim 12, wherein:

the oscillator bar drive motor is selected from the group consisting of stepper drive motors and servomotors; and a flexible synchronous drive member extends between the oscillator bar and the oscillator bar drive motor.

* * * * *